US006447556B1

(12) United States Patent
Cemenska et al.

(10) Patent No.: US 6,447,556 B1
(45) **Date of Patent: *Sep. 10, 2002**

(54) FUEL EMULSION BLENDING SYSTEM

(75) Inventors: Richard A. Cemenska, Edelstein, IL (US); Gerald N. Coleman, Peoria, IL (US); Ted W. Scheuermann, Peoria, IL (US)

(73) Assignee: Clean Fuel Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/201,597

(22) Filed: Nov. 30, 1998

Related U.S. Application Data

(63) Continuation-in-part of application No. 09/024,916, filed on Feb. 17, 1998, now Pat. No. 5,873,916.

(51) Int. Cl.[7] ..... C10L 1/32
(52) U.S. Cl. ..... 44/301; 123/25 R
(58) Field of Search ..... 123/1 A, 25 R, 123/25 C, 25 E; 44/301

(56) References Cited

U.S. PATENT DOCUMENTS

| | | | | |
|---|---|---|---|---|
| 2,784,747 A | | 3/1957 | Weempe | 141/21 |
| 2,928,436 A | | 3/1960 | Wendrow et al. | 141/105 |
| 3,602,003 A | | 8/1971 | Hampton | 62/54 |
| 3,963,000 A | | 6/1976 | Kosaka et al. | 123/3 |
| 4,114,661 A | | 9/1978 | Harris | 141/231 |
| 4,195,672 A | | 4/1980 | Freeman | 141/91 |
| 4,320,788 A | | 3/1982 | Lord | 141/290 |
| 4,526,633 A | | 7/1985 | Lawrence et al. | |
| 4,563,982 A | | 1/1986 | Pischinger et al. | 123/1 A |
| 4,732,181 A | | 3/1988 | Sollander et al. | 141/98 |
| 4,832,701 A | * | 5/1989 | Polanco et al. | 44/301 |
| 4,938,606 A | | 7/1990 | Kunz | 366/134 |
| 5,000,757 A | | 3/1991 | Puttock et al. | 44/301 |
| 5,234,035 A | | 8/1993 | Neeser | 141/1 |
| 5,298,230 A | | 3/1994 | Argabright et al. | 423/239.1 |
| 5,344,306 A | | 9/1994 | Brown et al. | 431/4 |
| 5,411,058 A | | 5/1995 | Welsh et al. | 137/572 |
| 5,419,852 A | | 5/1995 | Rivas et al. | 252/312 |
| 5,456,520 A | | 10/1995 | Adams et al. | 298/22 R |
| 5,469,830 A | | 11/1995 | Gonzalez | 123/515 |
| 5,503,772 A | | 4/1996 | Rivas et al. | 252/314 |
| 5,535,708 A | | 7/1996 | Valentine | 123/25 C |
| 5,560,344 A | | 10/1996 | Chan | 123/515 |
| 5,584,894 A | | 12/1996 | Peter-Hoblyn et al. | 44/301 |
| 5,603,864 A | * | 2/1997 | Silva et al. | 44/301 |
| 5,873,916 A | * | 2/1999 | Cemenska et al. | 123/25 R |

FOREIGN PATENT DOCUMENTS

| | | | |
|---|---|---|---|
| DE | 28 35 099 | 1/1979 | F02M/25/02 |
| GB | 1492936 | 11/1977 | |
| GB | 2264487 | 9/1993 | |
| WO | 95/06805 | 3/1995 | |

* cited by examiner

*Primary Examiner*—John Kwon
(74) *Attorney, Agent, or Firm*—Sierra Patent Group, Ltd.

(57) ABSTRACT

A transportable fuel emulsion blending system is provided. The disclosed embodiments of the transportable fuel emulsion blending system includes a plurality of fluid circuits, including a hydrocarbon circuit, a fuel emulsion additive circuit, a water circuit and an optional alcohol/methanol circuit all of which are disposed on a transportable platform such as a vehicle or moveable skid.

28 Claims, 5 Drawing Sheets

FUEL EMULSION BLENDING SYSTEM

RELATED APPLICATIONS

The present application is a continuation in part of U.S. patent application No. 09/024,916 filed Feb. 17, 1998, now issued as U.S. Pat. No. 5,873,916, the disclosure of which is hereby incorporated by reference.

FIELD OF THE INVENTION

The present invention relates to a fuel blending system, and more particularly to a moveable or mobile fuel emulsion blending system for blending an aqueous fuel emulsion from a source of hydrocarbon fuel, a source of water, and a source of fuel emulsion additives.

BACKGROUND

Recent fuel developments have resulted in a number of water blend fuel emulsions or aqueous fuel emulsions comprised essentially of a carbon based fuel, water, and various additives such as lubricants, emulsifiers, surfactants, corrosion inhibitors, cetane improvers, and the like. These fuel emulsions may play a key role in finding a cost-effective way for internal combustion engines including, but not limited to, compression ignition engines (i.e. diesel engines) to achieve the reduction in emissions below the mandated levels without significant modifications to the engines, fuel systems, or existing fuel delivery infrastructure.

Advantageously, water blend fuel emulsions tend to reduce or inhibit the formation of nitrogen oxides (NOx) and particulates (i.e. combination of soot and hydrocarbons) by altering the way the fuel is burned in the engine. Specifically, the fuel emulsions are burned at somewhat lower temperatures than a conventional diesel fuel due to the presence of water. This, coupled with the realization that at higher peak combustion temperatures, more NOx are typically produced in the engine exhaust, one can readily understand the advantage of using water blend fuel emulsions.

A major concern of such aqueous fuel emulsions or water blend fuels, however, is the stability of the fuel. As is well known in the art, the constituent parts of such fuel emulsions have a tendency to separate over time. Blending of the fuel emulsions in a manner to achieve long-term stability is essential if such fuels are to be commercially successful. The problems associated with fuel emulsion separation are very severe inasmuch as most engine operating characteristics are adjusted for a prescribed fuel composition. Where the fuel emulsion composition has changed due to ingredient separation, the engine performance is markedly diminished.

Several related art references have disclosed various devices or techniques for producing or blending a fuel emulsion for internal combustion engines. For example, U.S. Pat. No. 5,535,708 (Valentine) discloses a process for forming an emulsion of an aqueous urea solution in diesel fuel and combusting the same for the purposes of reducing NOx emissions from diesel engines. See also U.S. Pat. No. 4,938,606 (Kunz) discloses an apparatus for producing an emulsion for internal combustion engines that employs an oil line, a water line, a dosing apparatus and various mixing and storage chambers. Another related art process and system for blending a fuel emulsion is disclosed in U.S. Pat. No. 5,298,230 (Argabright) which discloses a specialized process for blending a fuel emulsification system useful for the reduction of NOx in a gas turbine.

The present invention addresses the aforementioned problems associated with separation of water blend and aqueous fuel emulsions by providing a blending system and method that enhances the long term stability of such emulsions.

SUMMARY OF THE INVENTION

The present invention is a transportable fuel emulsion blending system for blending a fuel emulsion from a source of hydrocarbon fuel, a source of water, and a source of fuel emulsion additives. Advantageously, the blending system enhances the long term stability of such fuel emulsions over that of conventional blending systems.

The present invention may be characterized as a transportable fuel emulsion blending system for blending a fuel emulsion from a source of water, a source of hydrocarbon fuel, and a source of fuel emulsion additives. The fuel emulsion blending system includes a transportable platform, such as a vehicle or moveable skid; a hydrocarbon fuel circuit and a fuel emulsion additive circuit both disposed on the platform; and a first blending station disposed on the platform and adapted to mix the hydrocarbon fuel and the fuel emulsion additives. The transportable fuel emulsion blending system also includes a second blending station disposed on the platform and adapted to mix the hydrocarbon fuel-additive mixture together with the water, and an emulsification station also disposed on the platform and adapted to emulsify said hydrocarbon fuel, fuel emulsion additive, and water mixture to yield a stable fuel emulsion.

An important aspect of the disclosed transportable fuel emulsion blending system is the ability for the blending system to be readily transportable from a first fueling location to an alternate fueling location. In addition, the disclosed fuel emulsion system is particularly suitable for blending fuel continuous fuel emulsions, although water continuous fuel emulsions can likewise be blended. Where water continuous emulsions are desired, the water-soluble fuel emulsion additives could be first combined with the water and subsequently mixed with the hydrocarbon. Moreover, the presently disclosed fuel emulsion blending system can also be easily adapted to blend fuel emulsions containing additional freeze depressants, such as methanol in addition to the standard fuel emulsion additive package.

Another important aspect of the presently disclosed embodiments of the fuel emulsion blending system is that it is operatively associated with a blending system controller. The blending system controller is adapted to govern the flow of the hydrocarbon fuel, water and fuel emulsion additives thereby controlling the mixing ratio in accordance with prescribed blending ratios.

BRIEF DESCRIPTION OF THE DRAWINGS

The above and other aspects, features, and advantages of the present invention will be more apparent from the following, more descriptive description thereof, presented in conjunction with the following drawings, wherein.

Corresponding reference numbers indicate corresponding components throughout the different embodiments depicted in the drawings.

DETAILED DESCRIPTION OF THE INVENTION

The following description is of the best modes presently contemplated for carrying out the present invention. The description is not to be taken in a limiting sense, but is made merely for the purpose of describing the general principles of the invention. The scope and breadth of the invention should be determined with reference to the claims.

Figure 1:
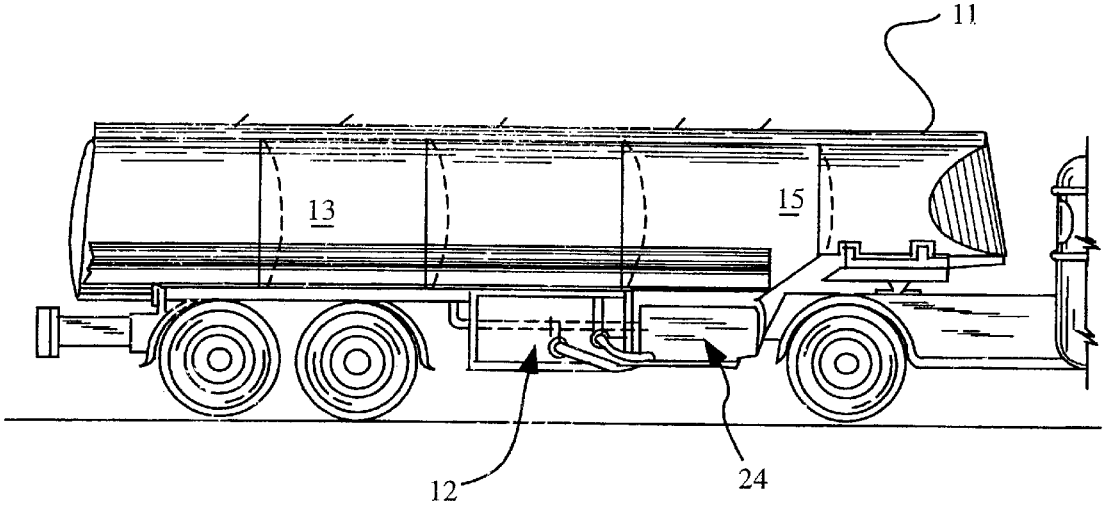
FIG. 1 is an illustration of the transportable fuel emulsion blending station on a vehicle in accordance with the present invention.
Figure 2:
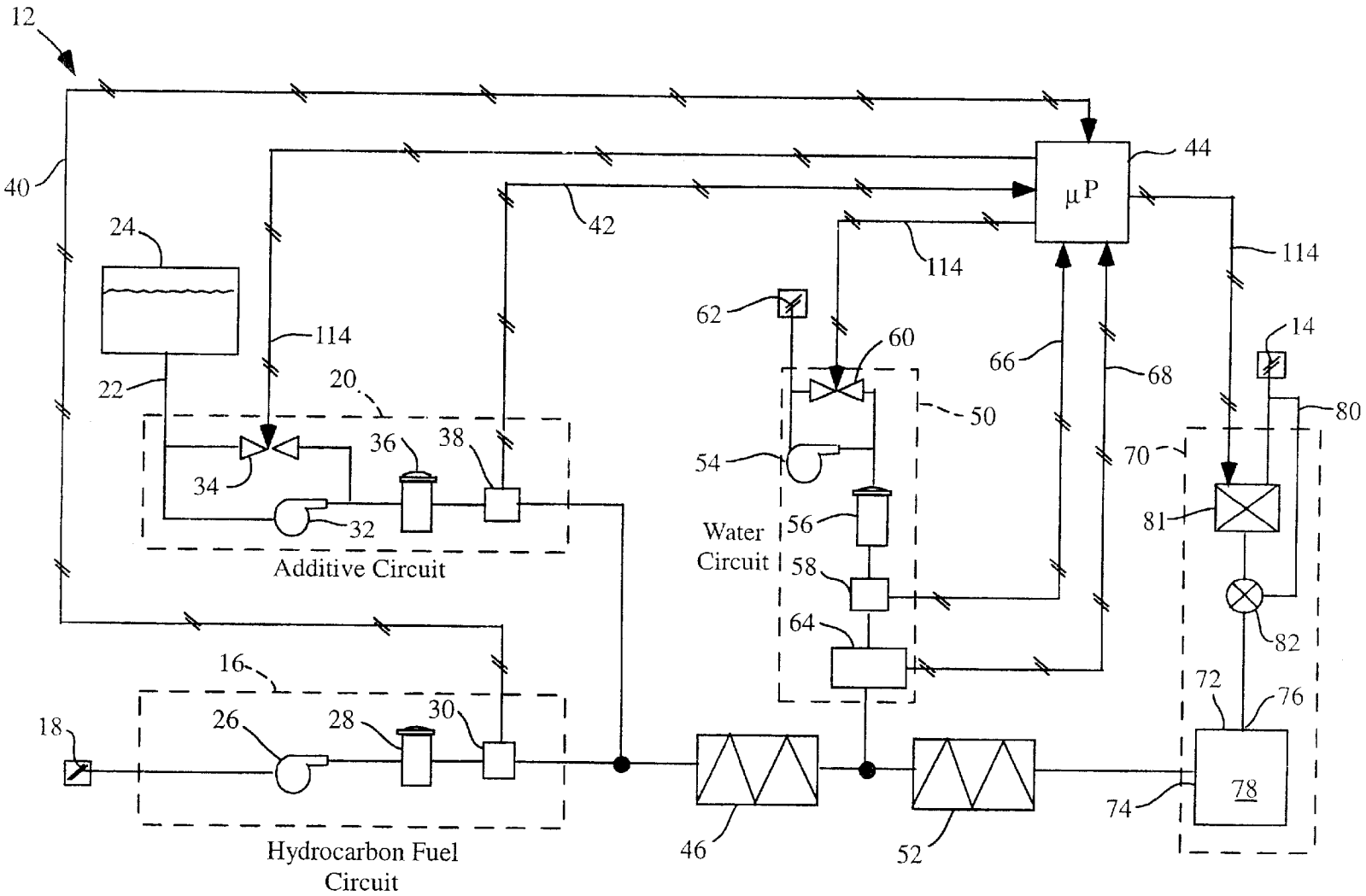
FIG. 2 is a more detailed schematic representation of the first embodiment of the fuel emulsion blending station.

Turning now to the drawings and particularly to FIG. 1 and FIG. 2 there is shown representations of a fuel emulsion blending system 12 disposed on a vehicle 11 having a plurality of storage compartments or storage tanks 13, 15, 24. As seen in the drawings, the illustrated embodiment of the fuel blending system 12 comprises a first fluid circuit 16 adapted for receiving hydrocarbon fuel at a first ingredient inlet 18 from a source of hydrocarbon fuel in a separate compartment 13 on the vehicle 11. The fuel blending system 12 also includes a second fluid circuit 20 adapted for receiving fuel emulsion additives at a second ingredient inlet 22 from an additive storage tank 24 or similar such source of fuel emulsion additives located on the vehicle 11.

As seen in FIG. 2, the first fluid circuit 16 also preferably includes a fuel pump 26 for transferring the hydrocarbon fuel, preferably a diesel fuel (although other hydrocarbon fuels can be used), from the source of hydrocarbon fuel to the blending system 12 at a selected flow rate, a 2 to 10 micron filter 28, and a flow measurement device 30 adapted to measure the flow rate of the incoming hydrocarbon fuel stream. The second fluid circuit 20 also includes a pump 32 for transferring the additives from the storage tank 24 to the blending system 12 at prescribed flow rates. The fuel additive flow rate within the second fluid circuit 20 is controlled by a flow control valve 34 interposed between the additive storage tank 24 and the pump 32. As with the first fluid circuit 16, the second fluid circuit 20 also includes a 2 to 10 micron filter 36 and a flow measurement device 38 adapted to measure the controlled flow rate of the incoming additive stream.

The signals 40, 42 generated from the flow measurement devices 30, 38 associated with the first and second fluid circuits are further coupled as inputs to a blending system controller 44.

The first fluid circuit 16 containing the hydrocarbon fuel and the second fluid circuit 20 adapted for supplying the fuel additives are coupled together and subsequently mixed together using a first in-line mixer 46. The resulting mixture of hydrocarbon fuel and fuel additives is then joined with a purified water stream supplied via a third fluid circuit 50 and subsequently mixed together using a second in-line mixer 52.

Referring again to FIGS. 1 and 2, the third fluid circuit 50 includes a water pump 54 for transferring the purified water from a source of water contained in a separate storage compartment 15 on the vehicle 11 at a selected flow rate to the blending system 12, a particulate filter 56 and a flow measurement device 58 adapted to measure the flow rate of the water stream. If the water in the storage compartment is not purified, the third fluid circuit may also include a reverse osmosis unit to purify the water to a prescribed level, as more fully described below. The water pump 54, filter 56 and flow measurement device 58 are serially arranged within the third fluid circuit 50. The water flow rate within the third fluid circuit 50 is preferably controlled using a flow control valve 60 interposed between the clean compartment and the water pump 54 proximate the third or water inlet 62. The third fluid circuit 50 also includes a specific conductance measurement device 64 disposed downstream of the flow measurement device 58 and adapted to monitor the quality of the water supplied to the blending system 12. The signals 66,68 generated from the flow measurement device 58 and the specific conductance measurement device 64 or other suitable measurement device in the third fluid circuit 50 are provided as inputs to the blending system controller 44. If the water quality is too poor or below a prescribed threshold, the blending system controller 44 may disable the blending system 12 until corrective measures are taken. In the preferred embodiment, the water quality threshold, as measured using the specific conductance measurement device 64, should be no greater than 20 microsiemens per centimeter. As indicated above, the purified water from the third fluid circuit 50 is joined with the hydrocarbon fuel and fuel additive mixture and subsequently re-mixed using the second in-line mixer 52 or equivalent blending station equipment.

The resulting mixture or combination of hydrocarbon fuel, fuel emulsion additives, and purified water are fed into an emulsification station 70. The emulsification station 70 includes a high shear mixing apparatus and optionally an aging reservoir 72 (Shown in FIG. 2). The optional aging reservoir 72 includes an inlet 74, an outlet 76 and a high volume chamber 78 or reservoir. The preferred embodiment of the blending system 12 operates using an aging time that is a function of emulsion temperature. For example, a three-minute aging time would be appropriate for room temperature mixture of the aqueous fuel emulsion or water blended fuel. Thus, in the three-minute aging time a blending system operating at an output flow rate of about 15 gallons per minute would utilize a 45-gallon tank as an aging reservoir.

The incoming stream of hydrocarbon fuel, fuel emulsion additives, and purified water are fed into the aging reservoir 72 at a location that preferably provides continuous agitation to the reservoir. Alternatively, the aging reservoir could include a mechanical mixing device associated therewith. The preferred embodiment of the blending system 12 also includes a continuous rotor-stator dispersion mill, such as the Kady Infinity model manufactured by Kady International in Scarborough, Me., or other high shear mixer 81 disposed downstream of the aging reservoir 72 which provides high shear mixing of the final fuel emulsion.

Figure 3:
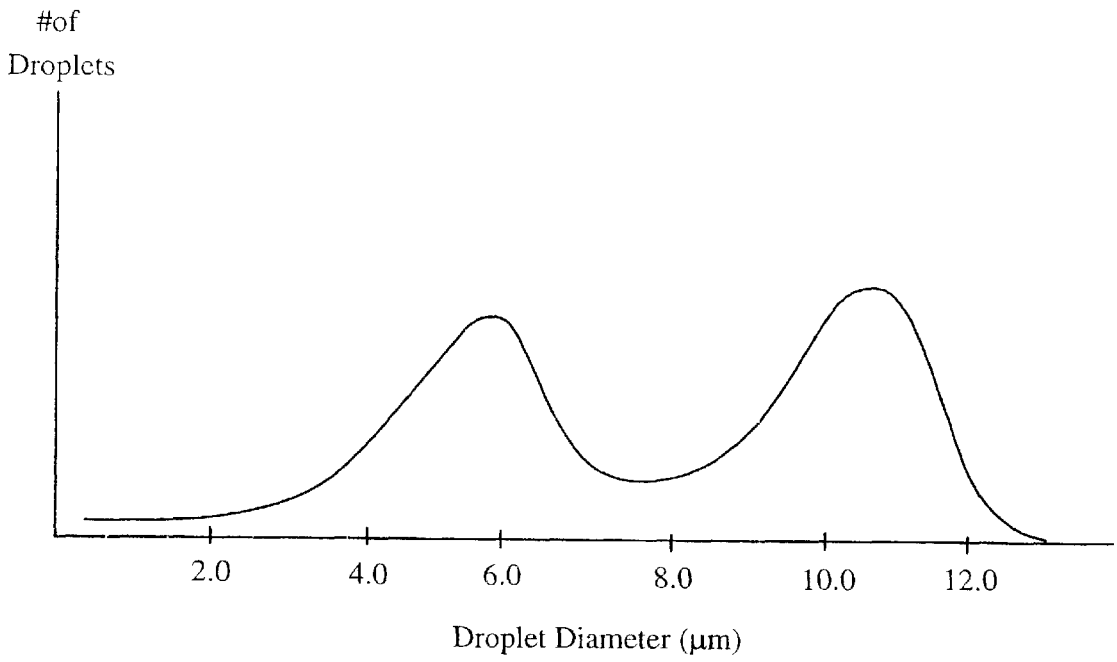
FIG. 3 is a graph that depicts the preferred droplet size distribution for a water continuous fuel emulsion prepared using the disclosed fuel emulsion blending system.

For optimum viscosity and stability in a water continuous fuel emulsion, a prescribed percentage of the fuel mixture flow (i.e. 10–50%) should bypass the high shear mixer 81 or dispersion mill. Such bypass flow can be accomplished using a bypass conduit 80 and associated valve 82 located within or near the emulsification station 70. Bypassing a prescribed percentage of the mixture flow around the dispersion mill 81 yields a final fuel emulsion having a bi-modal droplet size distribution, as generally represented in FIG. 3.

Figure 4:
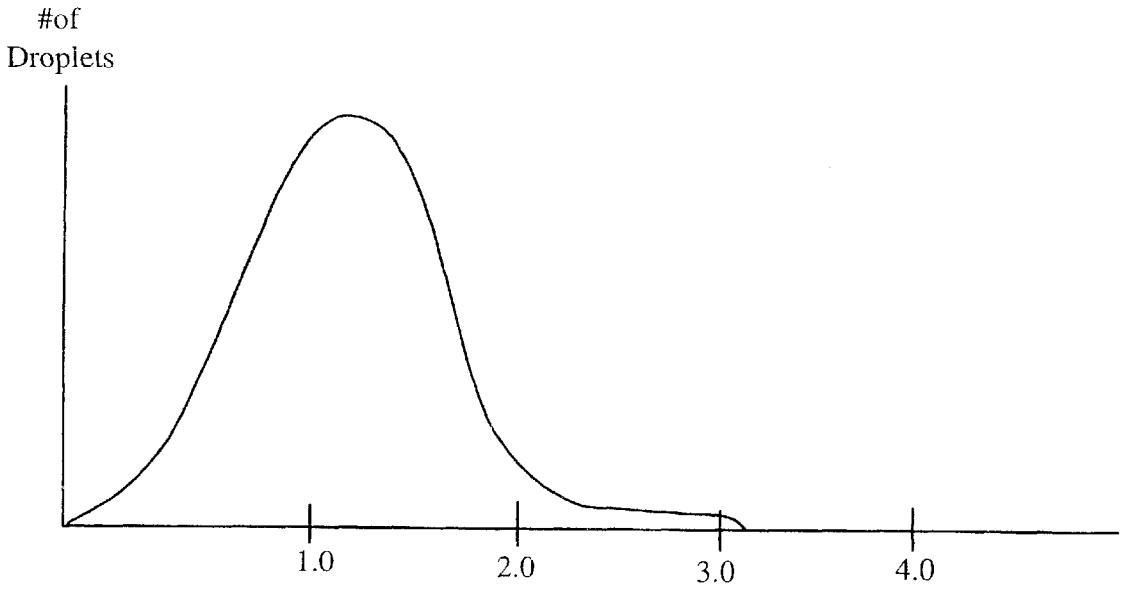
FIG. 4 is a graph that depicts the preferred droplet size distribution for a fuel continuous emulsion.

Conversely, to achieve optimum viscosity and stability in an oil continuous fuel emulsion, all of the fuel mixture flow should be directed through the high shear mixing device 81, such as a Ross X-series Mixer Emulsifier one or more times which results in the final fuel emulsion having a droplet size distribution as generally represented in FIG. 4. If more than one cycle through the high shear mixer 81, the blending system 12 should includes a re-cycle conduit to allow the emulsion mixture to make several or other prescribed number of passes through the high shear mixer 81.

As indicated above, the blending system controller 44 accepts as inputs the signals generated by the various flow measurement devices in the first, second and third fluid circuits, as well as any signals generated by the water quality measurement device together with various operator inputs such as prescribed fuel mix ratios and provides control signals for the flow control valve in the second fluid circuit and the flow control valve in the third fluid circuit. The illustrated embodiment of the blending system is preferably configured such that the hydrocarbon fuel stream is not precisely controlled but is precisely measured. Conversely, the purified water feed line and the fuel additive feed line are precisely controlled and precisely measured to yield a prescribed water blend fuel mix. The illustrated embodiment also shows the hydrocarbon fuel, purified water and fuel additive streams to be continuous feed so that the proper fuel blend ratio is continuously delivered to the shear pump. Alternatively, however, it may be desirable to configure the blending system such that the purified water stream is precisely measured but not precisely controlled while precisely controlling and measuring the hydrocarbon fuel feed line and the fuel additive feed line to yield a prescribed water blend fuel mix.

The above-described blending system is particularly suited for preparing a water blend fuel or aqueous fuel emulsion that uses a hydrocarbon fuel having a specific gravity in the range of about 0.70 to 0.90 and a viscosity in the range of about 1.0 to 30.0 cSt. The preferred volumetric ratio of hydrocarbon fuel is between about 50% to 90% of the total volume of the fuel emulsion. Accordingly, the preferred volumetric ratio of purified water is between about 10% to 50% of the total volume of the aqueous fuel emulsion or water blended fuel whereas the volumetric ratio of additives is between about 0.5% to 10.3% of the total volume of aqueous fuel emulsion or water blended fuel. As indicated above, hydrocarbon fuel is preferably a diesel fuel although alternative hydrocarbon fuels such as naphtha, gasoline, synthetic fuels or combinations thereof could also be used as the base hydrocarbon fuel. The fuel emulsion additives used in the above described blending system may include one or more of the following ingredients including surfactants, emulsifiers, detergents, defoamers, lubricants, corrosion inhibitors, and anti-freeze inhibitors such as methanol. Collectively, the additives have a specific gravity in the range of about 0.80 to 0.90 and a viscosity of about 0.8 cSt.

Figure 5:
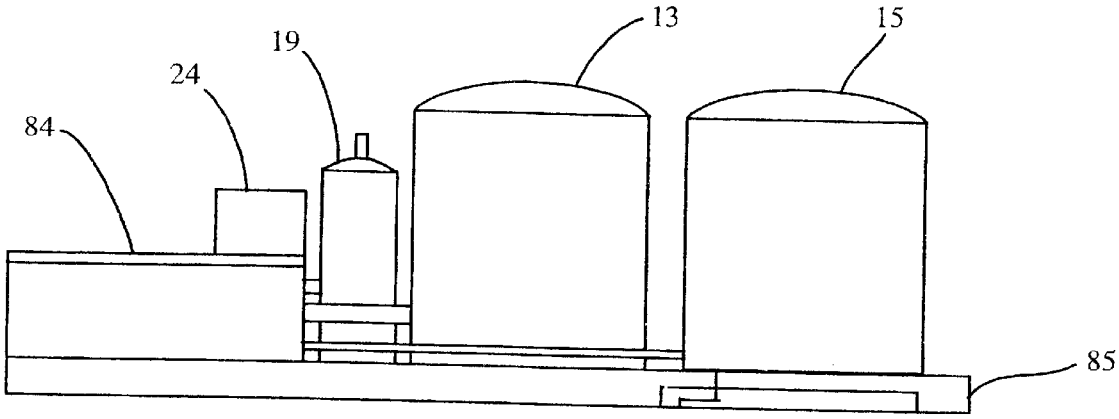
FIG. 5 is a representation of an alternate embodiment of the transportable fuel emulsion blending station shown on a moveable skid and including the optional storage tanks.
Figure 6:
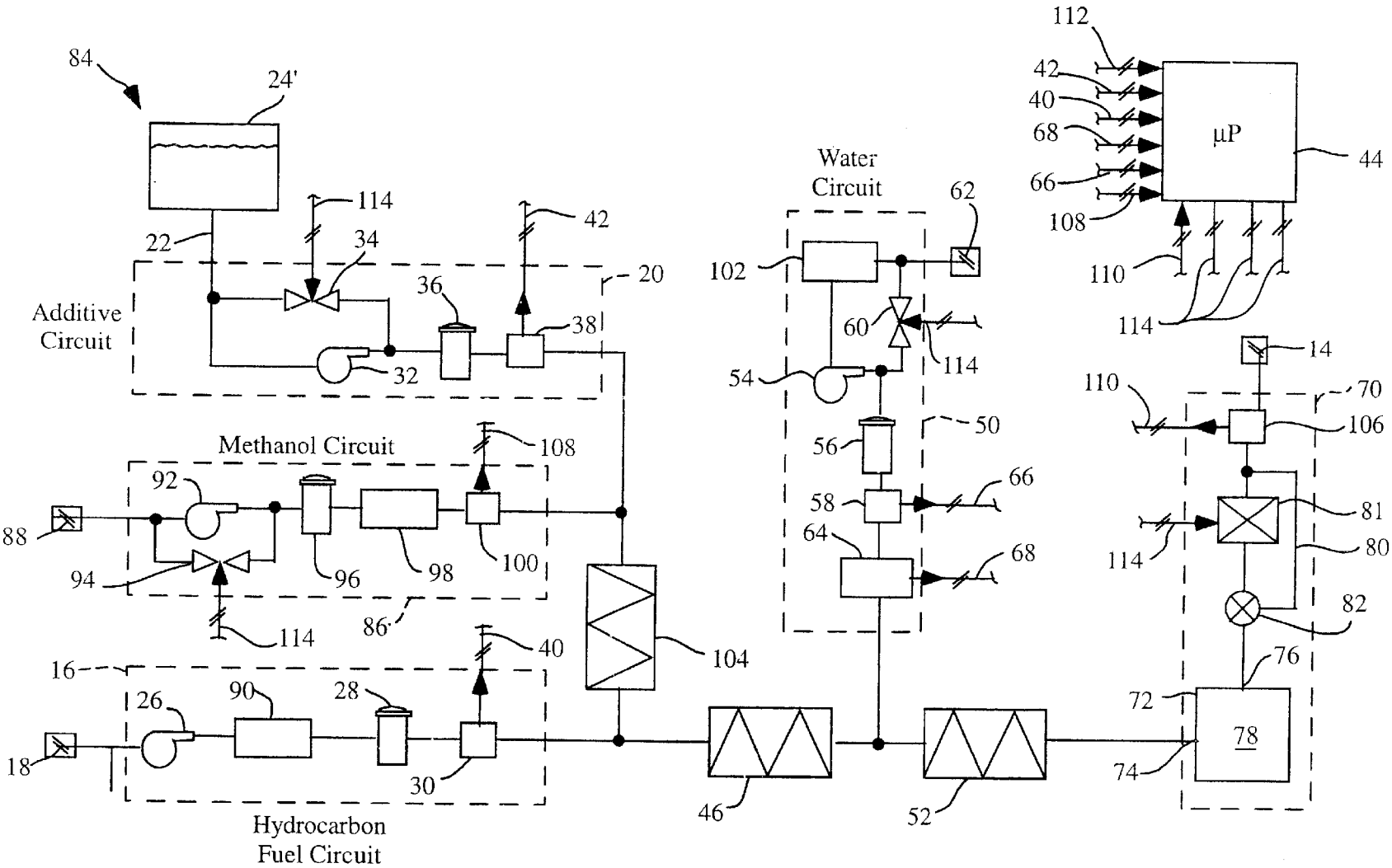
FIG. 6 is a schematic representation of the alternate embodiment of the transportable fuel emulsion blending station.

Turning now to FIG. 5 and FIG. 6, there is shown a schematic representation of an alternate embodiment of the fuel emulsion blending system 84. In many respects the embodiment of FIGS. 5 and 6 are similar to the embodiment of FIGS. 1 and 2 except for the replacement of the vehicle with a moveable skid 85, the inclusion of a fourth fluid circuit 86 and several other features of the fuel emulsion blending system 84 described herein. Much of the detailed description of the components or elements common to both embodiments are provided above with reference to FIG. 1 and thus will not be repeated here.

The fuel emulsion blending system 84 illustrated in FIG. 4 includes four fluid circuits inlets 18, 22, 62, 88 and a fuel emulsion outlet 14 disposed on a transportable or moveable platform 85 such as a skid. As described with reference to FIG. 1, the first fluid circuit 16 is adapted for receiving hydrocarbon fuel at the first ingredient inlet 18 from a source of hydrocarbon fuel while the second fluid circuit 20 is adapted for receiving fuel emulsion additives at a second ingredient inlet 22 from an additive storage tank 24, preferably a heated source of fuel emulsion additives. The third fluid circuit 50 is adapted for receiving water at the third ingredient inlet 62 from a source of water while the fourth fluid circuit 86 is adapted for receiving methanol at the fourth ingredient inlet 88 from an appropriate source of methanol. Alternatively, the hydrocarbon fuel, water and methanol source may be stored in separate storage tanks 13, 15, 19 also disposed on the platform 85 as depicted in FIG. 5, in lieu of being supplied from an external source. Likewise, the fuel emulsion additives may be supplied from an external source rather than from the illustrated additive storage tank 24.

As described above, the first fluid circuit 16 includes a fuel pump 26 for transferring the hydrocarbon fuel, preferably a diesel fuel, from the source of hydrocarbon fuel to the blending system 84 at a selected flow rate, a filter 28, and a flow measurement device 30 adapted to measure the flow rate of the incoming hydrocarbon fuel stream. In addition, the first fluid circuit 16 includes a heater 90 or other means for heating the hydrocarbon fuel component to a specified minimum temperature (e.g. 10 deg C.). Likewise, the second fluid circuit 20 also includes a pump 32 for transferring the fuel emulsion additives from the storage tank 24 where the additives are maintained at a specified minimum temperature to the blending system 84 at a prescribed flow rate. The fuel additive flow rate within the second fluid circuit 20 is controlled by a flow control valve 34 interposed between the additive storage tank 24' and the fuel emulsion additive pump 32. As with the first fluid circuit 16, the second fluid circuit 20 also includes a filter 36 and a flow measurement device 38 adapted to measure the flow rate of the incoming additive stream.

The fourth fluid circuit 86 includes a pump 92 and flow control valve 94, filter 96, heating element 98 and a flow measurement device 100. The pump 92, filter 96, heater 98, and flow measurement device 100 are serially arranged within the fourth fluid circuit 86. The methanol, ethanol or other antifreeze flow rate within the fourth fluid circuit 86 is preferably controlled using the flow control valve 94 which is interposed between the methanol source (not shown) and the pump 92 proximate the fourth ingredient inlet 88. The final or third fluid circuit 50 is the water fluid circuit that preferably includes a water purification system 102 such as a reverse osmosis purification system that heats and purifies the supplied water to prescribed temperatures and levels of purity, respectively. This third fluid circuit 50 also includes a water pump 54 and water flow control valve 60 for transferring the purified water at a selected flow rate to the blending system 84. As with the earlier described embodiment, the third fluid circuit 50 also includes a flow measurement device 58 adapted to measure the flow rate of the incoming purified water stream and a specific conductance measurement device 64 or other suitable measurement devices adapted to monitor the quality of the water supplied to the blending system 84.

The operation of the transportable fuel emulsion blending system 84 illustrated in FIG. 5 and FIG. 6 involves selective mixing of the ingredients from each of the fluid circuits. Preferably, the fourth fluid circuit 86 transporting methanol is coupled with the fluid circuit transporting the water. The resulting mixture of methanol and fuel additives is then joined with the first fluid circuit 16 supplying the hydrocarbon fuel component. Another in-line mixer 46 is used to mix the hydrocarbon fuel, fuel additives together. The purified water stream supplied via a third fluid circuit 50 is then added to the mixture and subsequently mixed together using yet another in-line mixer 52. The resulting mixture or combination of hydrocarbon fuel, fuel emulsion additives, methanol and purified water are fed into an emulsification station 70. The emulsification station 70 includes the aging reservoir 72, and also includes a continuous rotor-stator dispersion mill 81, such as the Kady Infinity Dispersion Mill disposed downstream of the aging reservoir 72 which provides the final aqueous fuel emulsion at the blending system outlet 14. Proximate the fuel emulsion outlet 14, there is disposed a final fuel emulsion density, viscosity, conductivity and/or opacity measurement device 106 which monitors the density and/or viscosity of the final fuel blend.

The signals 40, 42, 66, 108 generated from the flow measurement devices associated with the four fluid circuits together with the signals 68, 110 generated by the specific conductance measurement device 64 in the third fluid circuit 50 and the final emulsion density, opacity, conductance and/or viscosity measurement device 106 are provided as inputs to the blending system controller 44. The blending system controller 44 also accepts various operator inputs 112 such as prescribed fuel mix ratios and provides output control signals 114 for the flow control valves 34, 60, 94 in the second, third and fourth fluid circuits and, if appropriate the emulsification station 70.

Industrial Applicability

The presently disclosed embodiments of the transportable fuel emulsion blending system are ideally suited for applications requiring central fleet fueling of a number of on-highway or off-highway vehicles. Using a vehicle having multiple storage compartments, including a hydrocarbon fuel compartment separate from the water or additive compartments, allows the operator to service (i.e. fuel) those vehicles operating on a fuel emulsion as well as those vehicles operating on the straight hydrocarbon fuel (e.g. diesel fuel). Similarly, by controlling the flow rates of the various fluid circuits, even the skid mounted blending system could be adapted for delivering straight diesel fuel, a diesel fuel methanol (or similar alcohol) mix, a fuel emulsion of varying water content and varying alcohol content, etc. to the customer. For example, an advantage of the present blending system is it allows the delivery of straight fuel and fuel emulsions or both to the end user using the same delivery or blending equipment.

This on-site mobile mixing or transportable blending system approach (i.e. flexible delivery approach) is even more desirable from a customer's perspective than having premixed fuel emulsions delivered to the vehicles from a tax standpoint. In many operating scenarios, federal and state taxes are incurred based on the volume of hydrocarbon fuel bought by and delivered to the end user. Using a transportable blending system, as disclosed herein, the end user only pays taxes on the hydrocarbon fuel delivered to the site and not on the water delivered. Conversely, a premixed fuel emulsion delivery arrangement may incur taxes on each gallon of the final fuel emulsion product even where 20% or more of the fuel emulsion content is water. Accordingly, the on-site mobile mixing system or transportable blending system may drive the final cost per gallon of the fuel emulsions lower due to a decrease in applicable taxes.

From the foregoing, it should be appreciated that the present invention thus provides a transportable fuel emulsion blending system for blending a fuel emulsion from a source of hydrocarbon fuel, a source of water, and a source of fuel emulsion additives, including methanol. While the invention herein disclosed has been described by means of specific embodiments and processes associated therewith, numerous modifications and variations can be made thereto by those skilled in the art without departing from the scope of the invention as set forth in the claims or sacrificing all its material advantages.

What is claimed is:

1. A transportable fuel emulsion blending system for blending a fuel emulsion from a source of water, a source of hydrocarbon fuel, and a source of fuel emulsion additives, said fuel emulsion blending system comprising:

a transportable platform, a first fluid circuit disposed on said platform in flow communication with said source of hydrocarbon fuel;

a second fluid circuit disposed on said platform in flow communication with said source of fuel emulsion additives;

a first blending station disposed on said platform in flow communication with said first and second fluid circuits and adapted to mix said hydrocarbon fuel and said fuel emulsion additives;

a second blending station disposed on said platform in flow communication with said first blending station and said source of water, said second blending station adapted to mix said hydrocarbon fuel and additive mixture from said first blending station together with said water; and an emulsification station disposed on said platform in flow communication with said second blending station, said emulsification station adapted to emulsify said hydrocarbon fuel, fuel emulsion additives and water mixture to yield said fuel emulsion;

wherein said fuel emulsion blending system is readily transportable from a first location to an alternate location.

2. The fuel emulsion blending system of claim 1 wherein said emulsification station comprises a high shear mixer adapted to emulsify said hydrocarbon fuel, fuel emulsion additive and water mixture.

3. The fuel emulsion blending system of claim 2 wherein said emulsification station further comprises a recycling circuit adapted for recycling said fuel emulsion exiting said high shear mixer back through said high shear mixer.

4. The fuel emulsion blending system of claim 1 further comprising one or more holding tanks disposed on said platform and wherein said source of hydrocarbon fuel is disposed in one of said tanks.

5. The fuel emulsion blending system of claim 1 further comprising one or more holding tanks disposed on said platform and wherein said source of fuel emulsion additives is disposed in one of said tanks.

6. The fuel emulsion blending system of claim 5 further comprising a third fluid circuit disposed on said platform in flow communication with said source of water.

7. The fuel emulsion blending system of claim 6 wherein said third fluid circuit further includes a water purification unit for purifying said water to a prescribed purity level.

8. The fuel emulsion blending system of claim 7 wherein said third fluid circuit further includes a water conductivity sensor disposed in operative association with said third fluid circuit and adapted for measuring the purity of said water flowing through said third fluid circuit.

9. The fuel emulsion blending system of claim 6 wherein one or more of said fluid circuits includes a flow measuring device adapted for measuring the flow through said fluid circuit.

10. The fuel emulsion blending system of claim 6 wherein one or more of said fluid circuits include a flow control device adapted for adjusting the flow through said fluid circuit in response to a control signal received from said blending system controller.

11. The fuel emulsion blending system of claim 1 further comprising one or more holding tanks disposed on said platform and wherein said source of water is disposed in one of said tanks.

12. The fuel emulsion blending system of claim 1 further comprising a blending system controller operatively associated with one or more fluid circuits and adapted for controlling the mixing ratio of said hydrocarbon fuel, said fuel emulsion additives, and said water.

13. The fuel emulsion blending system of claim 1 wherein said first fluid circuit further includes a first heater adapted for heating said hydrocarbon fuel to a prescribed temperature.

14. The fuel emulsion blending system of claim 1 wherein said fuel emulsion is a fuel continuous emulsion.

15. The fuel emulsion blending system of claim 1 wherein said platform is disposed on a vehicle.

16. The fuel emulsion blending system of claim 1 wherein said platform is disposed on a moveable skid.

17. The fuel emulsion blending system of claim 1 wherein said emulsification station further comprises an aging reservoir in flow communication with said second blending station, said aging reservoir adapted for receiving and retaining said hydrocarbon fuel, fuel emulsion additive and water mixture for a prescribed duration.

18. The fuel emulsion blending system of claim 17 further comprising a bypass conduit in flow communication between said aging reservoir wherein a prescribed volume of said hydrocarbon fuel, fuel emulsion additive and water mixture bypasses the high shear mixer.

19. the fuel emulsion blending station of claim 1 wherein said fuel emulsion is a water continuous emulsion.

20. A fuel emulsion blending system for blending a fuel emulsion from a source of hydrocarbon fuel, a source of water, and a source of fuel emulsion additives, said fuel emulsion blending system comprising:

a first blending station in flow communication with said source of hydrocarbon fuel and said source of fuel emulsion additives, said first blending station adapted to mix said hydrocarbon fuel and said fuel emulsion additives;

a second blending station in flow communication with said first blending station and said source of water, said second blending station adapted to mix said hydrocarbon fuel and additive mixture from said first blending station together with said water; and an emulsification station in flow communication with said second blending station, said emulsification station adapted to emulsify said hydrocarbon fuel, fuel emulsion additives and water mixture to yield said fuel emulsion.

21. The fuel emulsion blending system of claim 20 wherein said fuel emulsion blending system is disposed on a vehicle.

22. The fuel emulsion blending system of claim 20 wherein said fuel emulsion blending system is disposed on a moveable skid.

23. The fuel emulsion blending system of claim 20 further comprising one or more holding tanks adapted to contain one of said sources.

24. The fuel emulsion blending system of claim 20 further comprising a blending system controller operatively associated with said blending stations and adapted for controlling the mixing ratio of said hydrocarbon fuel, said fuel emulsion additives, and said water.

25. The fuel emulsion blending system of claim 20 wherein said fuel emulsion is a fuel continuous emulsion.

26. The fuel emulsion blending system of claim 20 wherein said emulsification station comprises a high shear mixer.

27. the fuel emulsion blending station of claim 20 wherein said fuel emulsion is a water continuous emulsion.

28. The fuel emulsion blending system of claim 20 wherein said emulsification station further comprises an aging reservoir, a high shear mixer and a bypass conduit in flow communication with said aging reservoir and wherein a prescribed volume of said mixture bypasses said high shear mixer.

* * * * *